US010553952B1

(12) United States Patent
Sternowski

(10) Patent No.: US 10,553,952 B1
(45) Date of Patent: Feb. 4, 2020

(54) MULTI-CHANNEL TUNER-LESS COMPACT HF ANTENNA WITH HIGH ELEVATION ANGLE RADIATION

(71) Applicant: Softronics, Ltd., Marion, IA (US)

(72) Inventor: Robert H. Sternowski, Cedar Rapids, IA (US)

(73) Assignee: Softronics, Ltd., Marion, IA (US)

( * ) Notice: Subject to any disclaimer, the term of this patent is extended or adjusted under 35 U.S.C. 154(b) by 0 days.

(21) Appl. No.: 14/880,572

(22) Filed: Oct. 12, 2015

Related U.S. Application Data

(60) Provisional application No. 62/064,190, filed on Oct. 15, 2014.

(51) Int. Cl.

| | |
|---|---|
| ***H01Q 9/00*** | (2006.01) |
| ***H01Q 9/16*** | (2006.01) |
| ***H01Q 21/00*** | (2006.01) |
| ***H01Q 1/12*** | (2006.01) |

(52) U.S. Cl.
CPC ..... *H01Q 9/16* (2013.01); *H01Q 1/125* (2013.01); *H01Q 21/0006* (2013.01)

(58) Field of Classification Search
CPC ..... H01Q 9/16; H01Q 1/125; H01Q 21/0006
See application file for complete search history.

(56) References Cited

U.S. PATENT DOCUMENTS

| | | | | | |
|---|---|---|---|---|---|
| 3,618,105 | A * | 11/1971 | Bruene | H01Q 21/28 | 343/747 |
| 3,858,220 | A * | 12/1974 | Arnow | H01Q 1/362 | 343/802 |
| 4,101,897 | A * | 7/1978 | Morrison | H01Q 1/084 | 343/715 |
| 4,479,130 | A * | 10/1984 | Snyder | H01Q 9/16 | 343/802 |
| 5,528,252 | A * | 6/1996 | Skahill | H01Q 9/16 | 343/820 |
| 5,579,017 | A * | 11/1996 | Smith | H01Q 9/16 | 343/722 |
| 5,706,018 | A * | 1/1998 | Yankielun | H01Q 9/14 | 343/823 |

* cited by examiner

*Primary Examiner* — Dieu Hien T Duong
(74) *Attorney, Agent, or Firm* — Shuttleworth & Ingersoll, PLC; Jason Sytsma

(57) ABSTRACT

An antenna includes at least one dipole antenna comprising a pair of monopole antennas each monopole antenna includes an adjustable conductive element with one end electrically combined to an inductor and another end combined to an insulator. A support structure combined to the at least one dipole antenna positions one end of each monopole at an elevation higher than the other end of the monopole.

17 Claims, 3 Drawing Sheets

MULTI-CHANNEL TUNER-LESS COMPACT HF ANTENNA WITH HIGH ELEVATION ANGLE RADIATION

This application claims priority to U.S. Provisional Application 62/064,190 filed on Oct. 15, 2014, the contents of which are hereby incorporated by reference herein.

This disclosure relates to an antenna system, and, more specifically, this disclosure relates to an impedance matched antenna system with multiple preset frequencies.

BACKGROUND

Classical antennas range in length according to the operating wavelength. A fundamental dipole antenna is one-half wavelength long and monopoles (with an image antenna in the ground plane) are one-quarter wavelength long. High frequency (HF) communication in the 2-30 MHz range prefers a dipole antenna that ranges in length from 15 to 234 feet or a monopole that ranges in length from 8 to 117 feet. Shortening the physical and thus electrical length of an antenna (dipole or monopole) will exponentially lower the efficiency of the antenna, as well as drastically altering the impedance of the antenna, which can be matched to the radio's impedance to avoid significant loss of radio signals.

A monopole antenna is typically deployed as a vertical "whip" antenna, orthogonal to a surface (earth ground, ocean, metal surface, etc.). The monopole antenna is considered to be one-half of a classical dipole antenna, with the monopole itself comprising one-half of the dipole and the other half existing as a theoretical "image" monopole in the ground plane. Thus the monopole antenna's operation and performance is critically dependent upon the nature and conductive quality of the ground plane. In order to erect an efficient and useful antenna at HF frequencies, a large area free of obstructions is required.

However, HF radio communications are often required on vehicles, ships, aircraft and other movable platforms, most of which have a physical footprint that are significantly smaller than the physical length required by the classical dipole or monopole antennas to span the HF band of 2 to 30 MHz. Thus, an "electrically short" antenna is employed with the size tailored to fit the platform. When using such electrically short antennas a complex variable reactive impedance matching network (typically referred to as an "antenna coupler") is required to transform the frequency-dependent impedance of the antenna to an approximation of the fixed impedance of the radio (typically 50 ohms) according to fulfillment of the optimum power transfer theorem. These devices are expensive, complexly require many moving adjustments to maintain matching impedance, and often require placement near the antenna where they are exposed to the environment.

What is required is an alternative antenna system that is simple to construct and maintain, and requires no complex antenna couplers.

SUMMARY

An antenna system is disclosed. The antenna system includes at least one dipole antenna comprising a pair of monopole antennas each monopole antenna includes an adjustable conductive element with one end electrically combined to an inductor and another end combined to an insulator. A cable extends from the end of each monopole to a transceiver that is electrically coupled thereto. A support structure combined to the at least one dipole antenna positions one end of each monopole at an elevation higher than the other end of the monopole.

In an embodiment, there are a plurality of dipole antennas each tuned to correspond with one of up to ten predetermined frequency channels of interest in a High Frequency spectrum. The monopoles in the dipole antenna have an angle between seventy-five degrees and one hundred and twenty degrees between each. The optimal angle is ninety degrees. The support structure is positionable on a platform, such as a vehicle, with each monopole of the plurality of dipole antennas extending downward toward one of a front and a rear of the platform. The plurality of dipoles operates independently of the ground plane geometry and quality of the structure of the platform.

DETAILED DESCRIPTION

Figure 1:
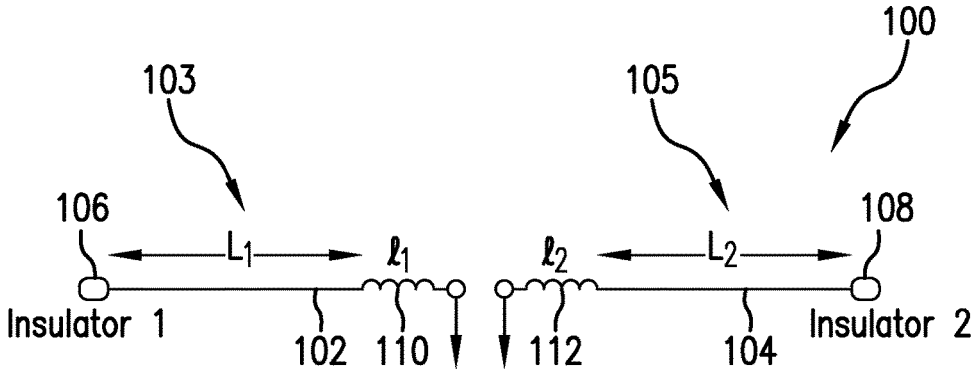
FIG. 1 shows a single dipole antenna according to an embodiment of the present disclosure.

A multi-channel antenna 1000 is disclosed in FIGS. 1-5. Multi-channel antenna 1000 efficiently receives or transmits a radio signal at any of a set of multiple frequencies without the need for retuning. Multi-channel antenna 1000 includes a multiplicity of adjustable-length, inductively-shortened dipole antennas 100, 200, 300, 400 connected in parallel at a common apex 500 which feed through a balanced transmission line 602 to a balancing transformer (Balun) 600 and out through a feed line 604 to a radio (where a radio can be a receiver, a transmitter, or transceiver for receiving or sending RF signals). Dipole antennas 100, 200, 300, 400 are configured in an "inverted vee" configuration with the center feed point elevated vertically so that the fanned-out ends of dipole antennas 100, 200, 300, 400 remain above and insulated from the ground plane, and such that the apex angle of the two identical halves of dipole antennas 100, 200, 300, 400 form an apex angle of 75 to 120 degrees (with any value in between and an optimal value of 90 degrees). In this regard, dipole antennas 100, 200, 300, 400 operate independently of the ground plane and the quality of the structure weldments, rust, corrosion, etc. lessens the efficiency) of vehicle 706. Balun 600 is used to transform signals to and from the radio via the unbalanced coaxial feed line 604, which can be an unbalanced coaxial feed line 604, to a balanced signal at apex 500 of multi-channel antenna 1000.

A single dipole antenna 100 is shown in FIG. 1. Dipole antenna 100 comprises two conductive elements 102, 104 (nominally metal, with flexible stranded wire preferred) of equal length, an insulator 106, 108 at the end of each conductive elements 102, 104, respectively, to prevent the tips from coming in contact with other objects, and an inductor 110, 112 at the base of insulator 106, 108, respectively, to cause dipole antenna 100 to be parallel resonant at the desired frequency. Inductor 110 and inductor 112 can be omitted if there's room to make conductive element 102 and conductive element 104, respectively, sufficiently long. The size of the inductors 110, 112 necessary to resonate monopoles 103, 105 at a fixed frequency is larger the further inductors 110, 112 are moved away from feed points 500*a*, 500*b* to the radio; conversely, the closer inductors 110, 112 are to feed points 500*a*, 500*b* the smaller (and less expensive) they are. Dipole antenna 100 can be regarded as a pair of monopoles 103, 105.

Tuning of dipole antenna 100 is accomplished in the disclosed invention by manually selecting a one of several preinstalled inductance values (the "coarse" tuning adjustment) and then adjusting the length of each conductive elements 102, 104 for resonance. The adjustment is mechanical. Conductive elements 102, 104 can be cut, wound, coiled, folded back into a loop and shorted, or can comprise of telescoping tubes or the like. Tuning is easily done by using a radio and observing the Voltage Standing Wave Ratio (VSWR) on an internal or external meter. The tuning of dipole antenna 100 is adjusted for the lowest possible VSWR, indicating the best achievable impedance match and hence best efficiency of dipole antenna 100.

Figure 2:
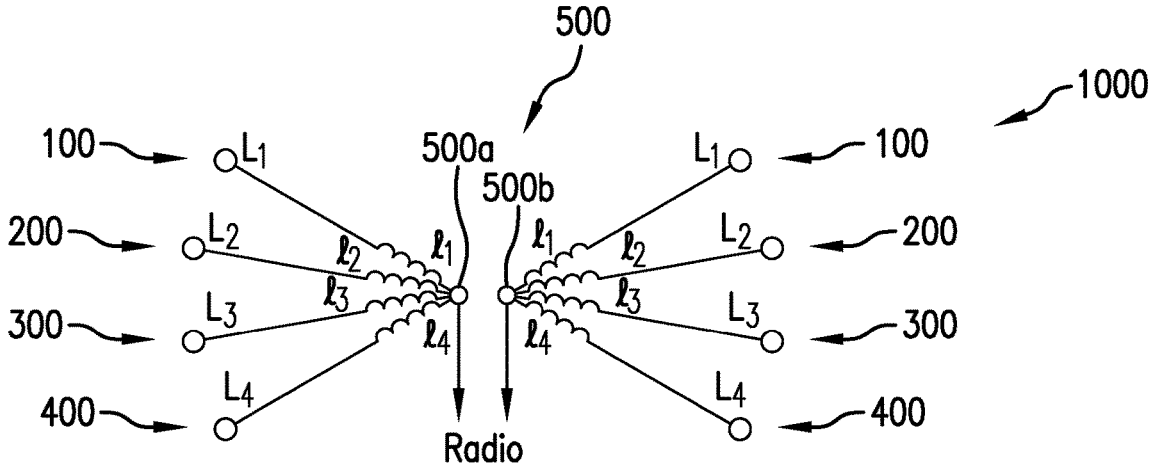
FIG. 2 shows a multi-channel antenna with multiple dipole antennas of FIG. 1.

A multi-channel antenna 1000 is shown in FIG. 2. It comprises of a multiplicity (according to the desired number of channels, one per channel) of dipole antennas 100, 200, 300, 400 shown in FIG. 1 connected to a common apex 500 (with poles or feed points 500*a*, 500*b* to the radio). Dipole antennas 100, 200, 300, 400 are each fanned out at the ends as much as space allows to minimize tuning interaction. Some iteration in tuning may be required for each dipole antenna 100, 200, 300, 400, as tuning of one of dipole antennas 100, 200, 300, 400 will impact the tuning of others by a small degree. Once tuned, dipole antennas 100, 200, 300, 400 need never be retuned unless a channel is changed.

Figure 3:
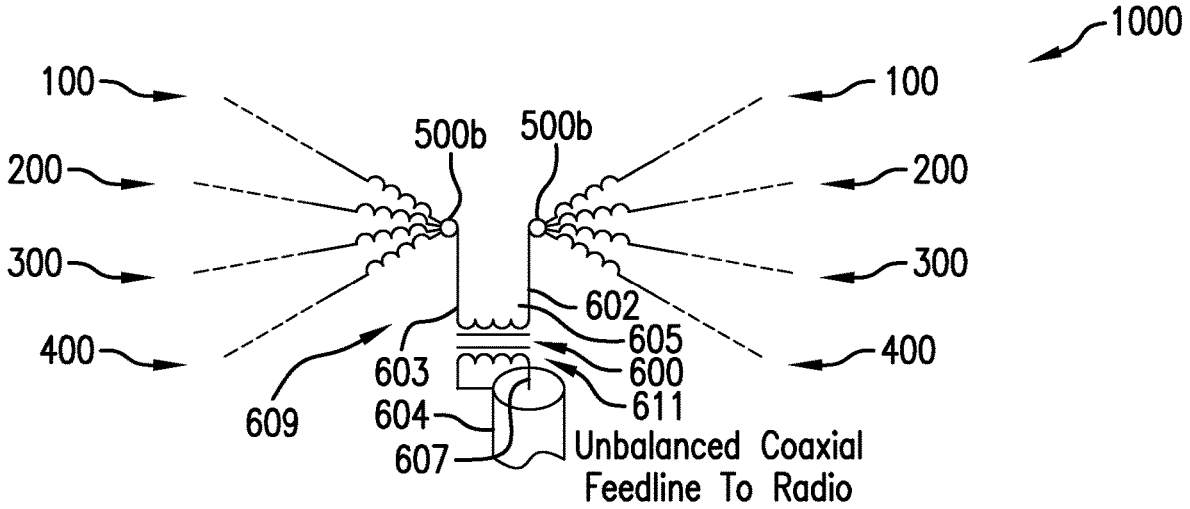
FIG. 3 shows the multi-channel antenna of FIG. 2 connected to a balun transformer.

FIG. 3 shows multi-channel antenna 1000 connected to balun 600 used to drive the paralleled dipole antennas 100, 200, 300, 400, as described in FIG. 3. Balun 600 has two functions: (1) Balun 600 balances multi-channel antenna 1000 with respect to ground and minimizes the vehicle ground impact; and (2) The turns-ratio of Balun 600 is N:M, where the turns-ratio of balun 600 is based on the real impedance of multi-channel antenna 1000 and the radio, in order to provide a more optimal 2-30 MHz broadband impedance match between multi-channel antenna 1000 and radio. Balun 600 has a balanced side 609 with a first node 603 and a second node 605 and an unbalanced side 611 with a single node 607, wherein one monopole 103 of the pair of monopoles 103,105 of dipole antenna 100 is connected to first node 603 of balanced side 609 of Balun 600 and one monopole 105 of the pair of monopoles 103, 105 of dipole antenna 100 is connected to second node 605 of balanced side 60 of Balun 600, and unbalanced side 611 is electrically connected to a transceiver.

Figure 4:
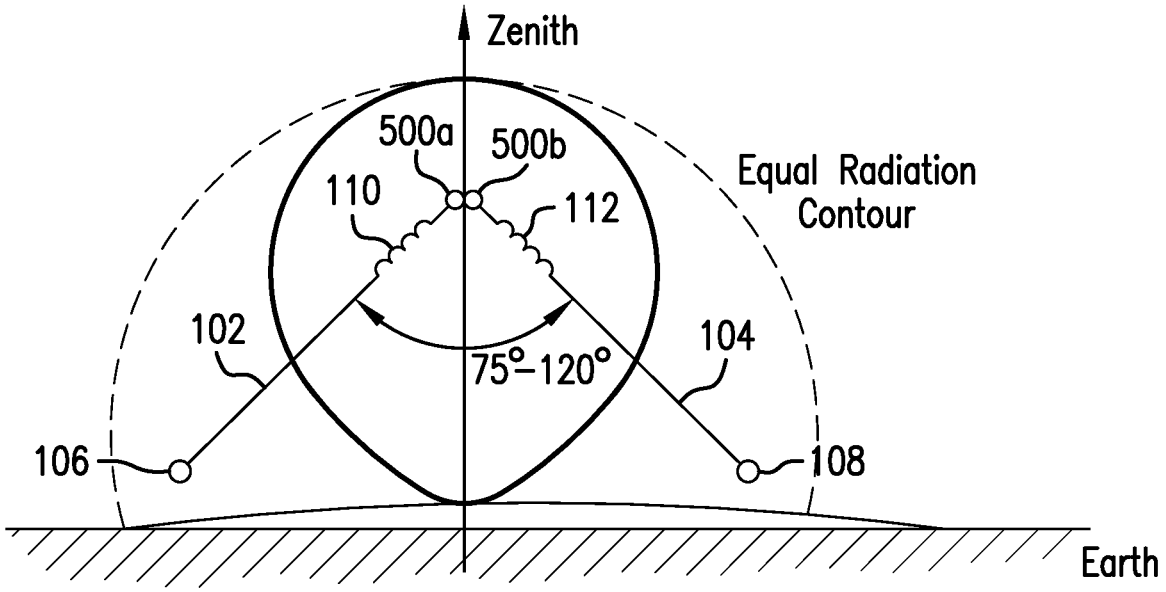
FIG. 4 shows the single dipole antenna of FIG. 1 with an elevated apex to create a generally circular shaped radiation pattern.

The center of each dipole antenna 100, 200, 300, 400 of multi-channel antenna 1000 is elevated as shown in FIG. 4 to obtain a dipole apex angle in the range of 75 to 120 degrees (with any range or any value in between, and preferably 90 degrees), the exact angle not being critical to the electrical performance over the mechanical implementation. A range of 75-120 degrees will create a generally circular radiation pattern from each dipole antenna 100, 200, 300, 400, where a 90 degree angle will generate a more circular radiation pattern.

Figure 5A:
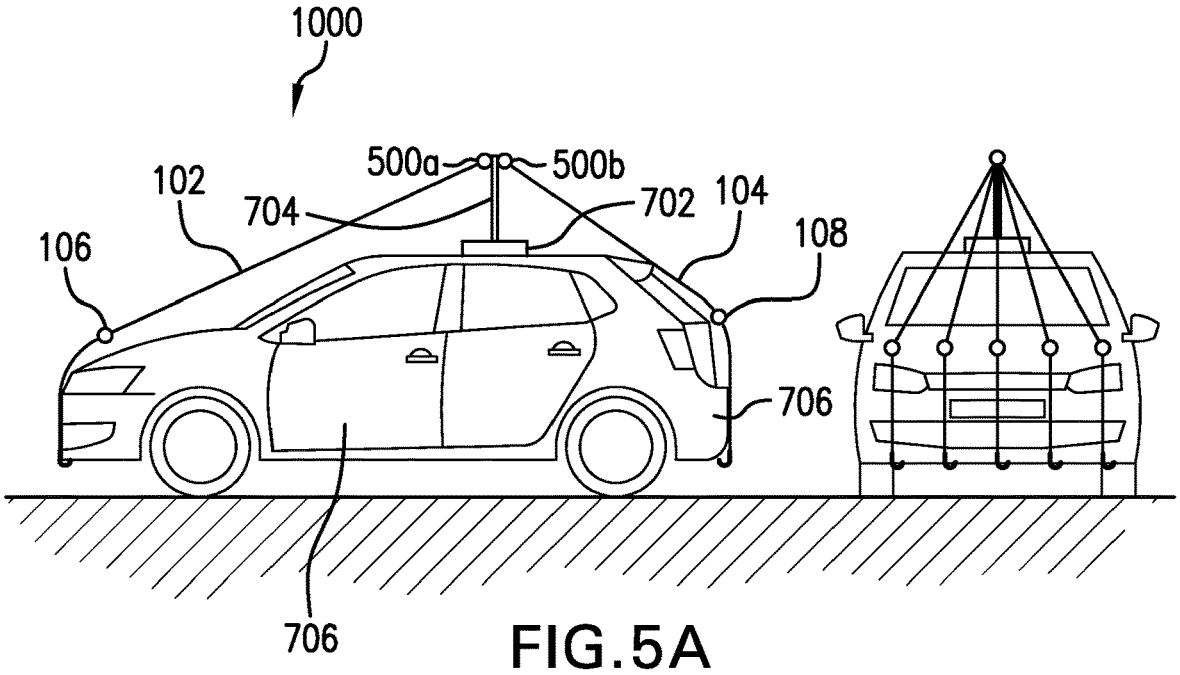
FIG. 5A shows a side-view of the multi-channel antenna of FIG. 3 positioned on a mast of a vehicle.
Figure 5B:
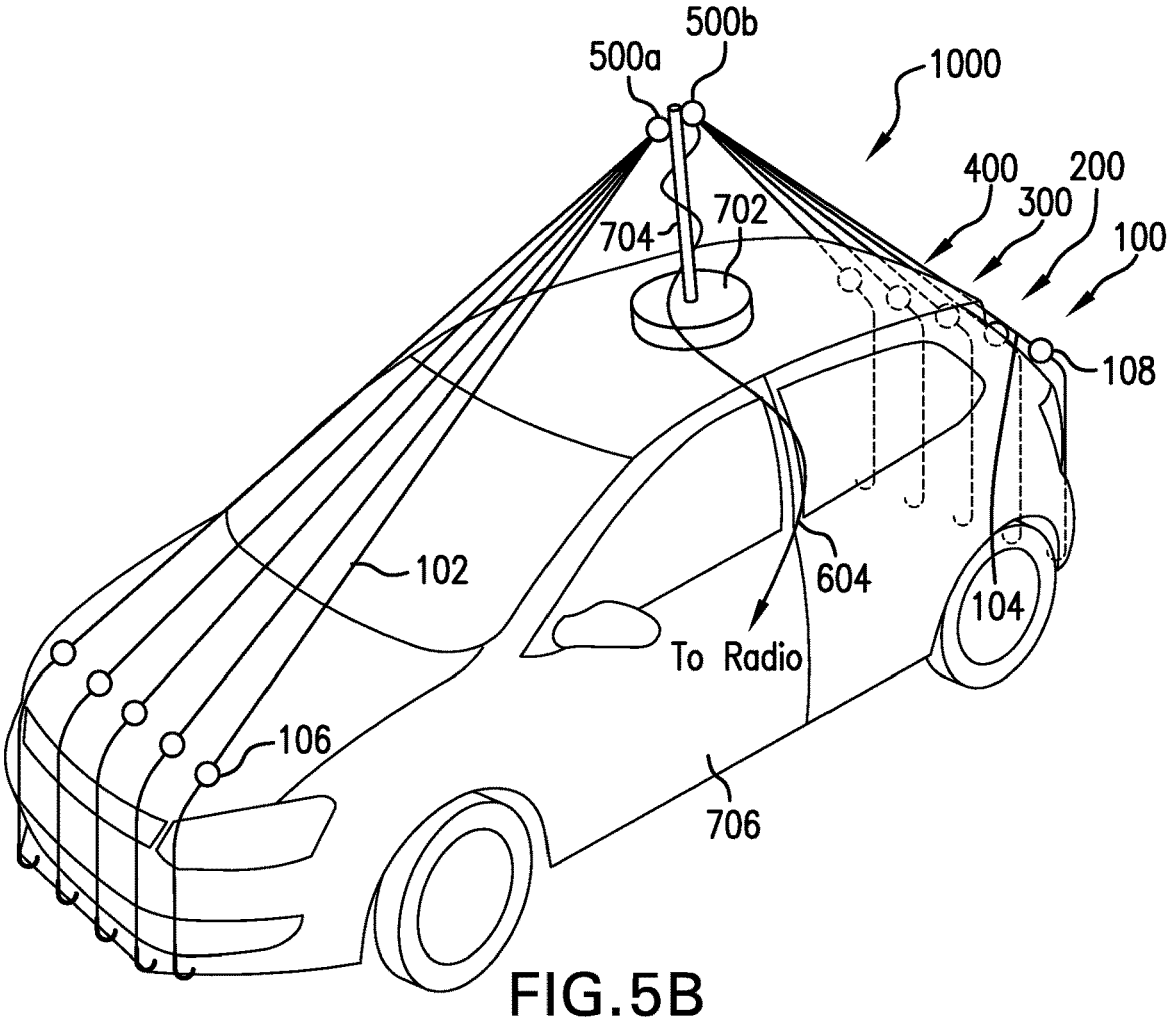
FIG. 5B shows a perspective view of the multi-channel antenna and vehicle of FIG. 5A.

FIGS. 5*a* and 5*b* show multi-channel antenna 1000 mounted on a center support structure 700 that may be affixed temporarily or permanently to a vehicle 706 as desired. A magnetic base 702 with mast 704 provides an easily and quickly removable support structure 700.

The physical implementation of multi-channel antenna 1000 offers a compact footprint, rugged construction by nature of the design, inexpensive materials, simple tuning to the desired frequency, and rapid erection time. Antenna 1000 is suited for use in fixed terrestrial applications or moving platforms (i.e., vehicles, boats, ships, aircraft, etc.) where a quick-erection and/or compact antenna is needed with high elevation angle radiation.

Multi-channel antenna 1000 optimizes the radiation near zenith where it will be most useful for a mobile platform or low power transmitter. Multi-channel antenna 1000 is unlikely to be used in long range communication with a nominal 100 watt vehicular radio so low elevation angle radiation is wasted energy. Furthermore, a mobile platform on a vehicle is inherently at ground level, nominally surrounded most of the time (statistically) by trees, buildings, hills, and other obstructions which block low elevation angle radio waves from traveling long distances, so, again, any low elevation angle radiation is wasted energy.

Multi-channel antenna 1000 also relies on international treaty conventions on radio use, specifically, that a user is only authorized the use of certain exact frequencies for which he has received prior permission. Such treaties are in effect worldwide under oversight of the International Telecommunications Union (ITU), and implemented/enforced by the signatory country regulatory agencies (i.e., the FCC in the US). Further, signatories to the ITU treaties further agree to abide by frequency band allocations. More specifically, the 2-30 MHz HF band is divided up into smaller sub-bands, each of which is restricted to a specific use. Within those allocations, there are twenty seven (27) sub-bands in which fixed or mobile HF radios are allowed to operate. A user requests and receive permission to use a specific frequency within whatever bands are appropriate to his communication needs. A typical user is assigned no more than ten (10) channels on which he may communicate. Once assigned, these channels rarely if ever change. Thus, multi-channel antenna 1000 has no need to be tuned to any frequency between 2 and 30 MHz, but rather to maybe ten (10) individual frequencies between 2 and 30 MHz. This is accomplished by manually tuning each dipole antenna 100, 200, 300, 400 to an assigned channel, and then connecting all of dipole antennas 100, 200, 300, 400 in parallel at the apex 500. While only four dipole antennas 100, 200, 300, 400 are shown, this disclosure contemplates ten to cover ten channels between 2 and 30 MHz (or any number of dipoles between one and ten or more than 10).

Multi-channel antenna 1000 eliminates the variable-tuning antenna coupler by using multiple tuned dipole antennas 100, 200, 300, 400 each presenting an optimum impedance to the radio at its preset frequency. Multi-channel antenna 1000 utilize an electrically-short antenna commensurate with vehicle size by sizing the dipole lengths to the size of the vehicle, nominally 16 feet (8 feet per half) and using loading coils to electrically lengthen the respective dipole antennas 100, 200, 300, 400. Multi-channel antenna 1000 presents an optimum impedance to the radio at all required frequencies by tuning each dipole antenna 100, 200, 300, 400 to each assigned frequency and applying a signal simultaneously to each dipole antenna 100, 200, 300, 400 whereby only one dipole antenna 100, 200, 300, 400 will accept power due to its impedance on the selected frequency. Multi-channel antenna 1000 eliminates retuning or tune time when changing among assigned frequencies in the same manner as presenting the optimum impedance to the radio at all required frequencies.

Multi-channel antenna 1000 further is a balanced antenna without an image half in the ground plane and is enhanced by use of a balun 600 at the antenna center feed point to minimize impact on the performance of multi-channel antenna 1000 when combined to a typically poor vehicle ground plane. Multi-channel antenna 1000 also optimizes the radiation pattern toward zenith rather than the horizon (since long-range HF communication will be unlikely from a vehicle) by "folding" the dipole antennas into an inverted vee configuration (as shown in FIGS. 4-5) to obtain an omnidirectional high elevation radiation pattern appropriate for short to medium range communications to/from a vehicle at ground level.

While the present invention has been particularly shown and described with reference to exemplary embodiments thereof, it should be understood by those of ordinary skill in the art that various changes, substitutions and alterations can be made herein without departing from the scope of the invention as defined by appended claims and their equivalents.

What is claimed is:

1. An antenna system comprising:

at least one dipole antenna comprising a pair of monopole antennas each monopole antenna including an adjustable in length conductive element with one end electrically combined to an inductor and another end combined to an insulator, wherein the inductor of each monopole is separate and distinct from each other to encourage parallel resonance at the desired frequency in the at least one dipole antenna;

a support structure electrically isolated from and independent of the at least one dipole antenna that is combined to the at least one dipole antenna adapted to position the one end of each monopole antenna at an elevation higher than the other end of the monopole antenna; and a balancing transformer with a balanced side comprising a first node and a second node and an unbalanced side comprising a single node, wherein one monopole antenna of the pair of monopole antennas of the at least one dipole antenna is connected to the first node of the balanced side of the balancing transformer and one monopole antenna of the pair of monopole antennas of the at least one dipole antenna is connected to the second node of the balanced side of the balancing transformer, and the unbalanced side is electrically connected to a transceiver.

2. The antenna system of claim 1, and further comprising a substantially ninety degree angle between each monopole antenna of the at least one dipole antenna.

3. The antenna system of claim 1, and further comprising an angle between seventy-five degrees and one hundred and twenty degrees between each monopole antenna of the at least one dipole antenna.

4. The antenna system of claim 1, and further comprising a plurality of dipole antennas.

5. The antenna system of claim 4, wherein the adjustable conductive element of each of the plurality of dipole antennas is adjusted to tune each of the plurality of dipole antennas to a predetermined frequency.

6. The antenna system of claim 5, wherein the adjustable conductive element of each of the plurality of dipole antennas is adjusted by changing a length of the adjustable element.

7. The antenna system of claim 6, wherein each of the plurality of dipole antennas is tuned to correspond with one of up to ten predetermined frequency channels of interest in a High Frequency spectrum.

8. The antenna system of claim 4, wherein the support structure is positionable on a movable platform and each monopole antenna of the plurality of the dipole antennas extends downward toward one of a front and a rear of the movable platform.

9. The antenna system of claim 8, wherein the plurality of the dipole antennas operate independently of properties of a ground plane of the movable platform.

10. An antenna system comprising:

at least one dipole antenna comprising a pair of monopole antennas each monopole antenna including a conductive element that is adjustable in length with one end electrically combined to a feed point and another end combined to an insulator;

a radio electrically coupled to the feed point of the at least one dipole antenna;

a support structure electrically isolated from and independent of the at least one dipole antenna that is combined to the at least one dipole antenna adapted to position the one end of each monopole antenna at an elevation higher than the other end of the monopole antenna; and an inductor electrically connected between each conductive element and each feed point to the radio, wherein the inductor between each conductive element and each feed point to the radio is separate and distinct from each other to encourage parallel resonance at the desired frequency in the at least one dipole antenna.

11. The antenna system of claim 10, and further comprising a movable platform electrically separate from a ground plane, the support structure positioned on the movable platform.

12. The antenna system of claim 11, wherein inductor of the monopole has a higher elevation that the insulator at the other end of the monopole.

13. The antenna system of claim 12, wherein the conductive element is adjustable to tune the dipole antenna to a predetermined frequency.

14. The antenna system of claim 13, wherein each monopole of the dipole antenna is at an angle between seventy-five degrees and one hundred and, twenty degrees with respect to each other.

15. The antenna system of claim 14, wherein the at least one dipole antenna operate independently of a ground plane and a quality of a structure of the movable platform.

16. The antenna system of claim 10, and further comprising the inductor positioned at any physical position in an electrical path between the insulator and the feed point to the radio.

17. The antenna system of claim 16, wherein the feed point to the radio has a higher elevation that the insulator at the other end of the monopole.

* * * * *